US007753216B2

(12) United States Patent
Kao

(10) Patent No.: US 7,753,216 B2
(45) Date of Patent: Jul. 13, 2010

(54) TOOL SUSPENSION DEVICE

(76) Inventor: Jui-Chien Kao, No. 358, Tunghsing Rd., Shuwang Li, Tali City, Taichung Hisen (TW)

( * ) Notice: Subject to any disclaimer, the term of this patent is extended or adjusted under 35 U.S.C. 154(b) by 408 days.

(21) Appl. No.: 11/984,948

(22) Filed: Nov. 26, 2007

(65) Prior Publication Data

US 2009/0134288 A1 May 28, 2009

(51) Int. Cl.
*A47F 7/00* (2006.01)

(52) U.S. Cl. ..... 211/70.6

(58) Field of Classification Search ..... 211/70.6, 211/69, 94.01, 175, 66; 206/376–378, 372–373, 206/493, 806; 248/316.4; 269/43, 291, 45
See application file for complete search history.

(56) References Cited

U.S. PATENT DOCUMENTS 3,889,809 A * 6/1975 McNair ..... 206/372
5,398,823 A * 3/1995 Anders ..... 211/70.6
5,467,874 A * 11/1995 Whitaker ..... 206/378
6,712,225 B2 * 3/2004 McNeely ..... 211/70.6
7,137,514 B1 * 11/2006 Nickipuck ..... 211/70.6
7,152,747 B2 * 12/2006 Wang ..... 211/70.6
7,641,062 B2 * 1/2010 Arakawa ..... 211/117
2003/0024837 A1 * 2/2003 Chen ..... 206/378
2008/0000853 A1 * 1/2008 Huang ..... 211/70.6
2008/0047911 A1 * 2/2008 Kao ..... 211/70.6
2009/0184070 A1 * 7/2009 Kao ..... 211/70.6
2009/0194494 A1 * 8/2009 Kao ..... 211/70.6

* cited by examiner

*Primary Examiner*—Jennifer E. Novosad
(74) *Attorney, Agent, or Firm*—Muncy, Geissler, Olds & Lowe, PLLC

(57) ABSTRACT

A tool suspension device has a base bracket and multiple clamps. The base bracket has a baseboard and a rail bracket. The rail bracket is formed securely on the baseboard and has a rail and two longitudinal grooves. The rail has multiple detents formed in a front surface of the rail. The clamps are slidably mounted on the rail in pairs. Each clamp has two hooks and an arm. The hooks are respectively mounted slidably in the longitudinal grooves of the rail. The arm is formed on and protrudes out from the hooks and has a jaw recess, a mounting recess and a boss. The mounting recess is formed in the arm and corresponds to one of the detents in the rail. The boss is mounted in the mounting recess and engages the corresponding detent.

10 Claims, 8 Drawing Sheets

TOOL SUSPENSION DEVICE

BACKGROUND OF THE INVENTION

1. Field of the Invention

The present invention relates to a tool suspension device, especially to a tool suspension device that can be movably adjusted to hold tools conveniently and easily.

2. Description of the Prior Arts

Tool suspension devices are used to hold tools such as wrenches, screwdrivers or sockets on a wall. A conventional suspension device has a baseboard and multiple stationary holders. The baseboard has multiple hanging holes formed through the base bracket to allow the baseboard to be mounted on the wall by fasteners. The stationary holders are fixed loops connected securely to the baseboard to hold tools on the conventional suspension device.

However, because the holders are immovably connected to the baseboard and an interval between adjacent holders is fixed, the interval between adjacent holders cannot be changed to match the width of the held tool, and is therefore inconvenient to use.

To overcome the shortcomings, the present invention provides a tool suspension device to mitigate or obviate the aforementioned problems.

SUMMARY OF THE INVENTION

The main objective of the present invention is to provide a tool suspension device that can be movably adjusted to hold tools conveniently and easily.

The tool suspension device in accordance with the present invention has a base bracket and multiple clamps. The base bracket has a baseboard and a rail bracket. The rail bracket is formed securely on the front surface of the baseboard and has a rail and two longitudinal grooves formed in the rail. The rail has multiple detents formed in a front surface of the rail. The clamps are slidably mounted on the rail in pairs. Each clamp has two hooks and an arm. The hooks are respectively mounted slidably in the longitudinal grooves of the rail. The arm is formed on and protrudes out from the hooks and has a jaw recess, a mounting recess and a boss. The jaw recess is formed in a side surface of the arm. The mounting recess is formed in the arm and corresponds to one of the detents in the rail. The boss is mounted in the mounting recess and engages the corresponding detent and has a plug, a ball and a spring.

Other objectives, advantages and novel features of the invention will become more apparent from the following detailed description when taken in conjunction with the accompanying drawings.

DETAILED DESCRIPTION OF PREFERRED EMBODIMENTS

Figure 1:
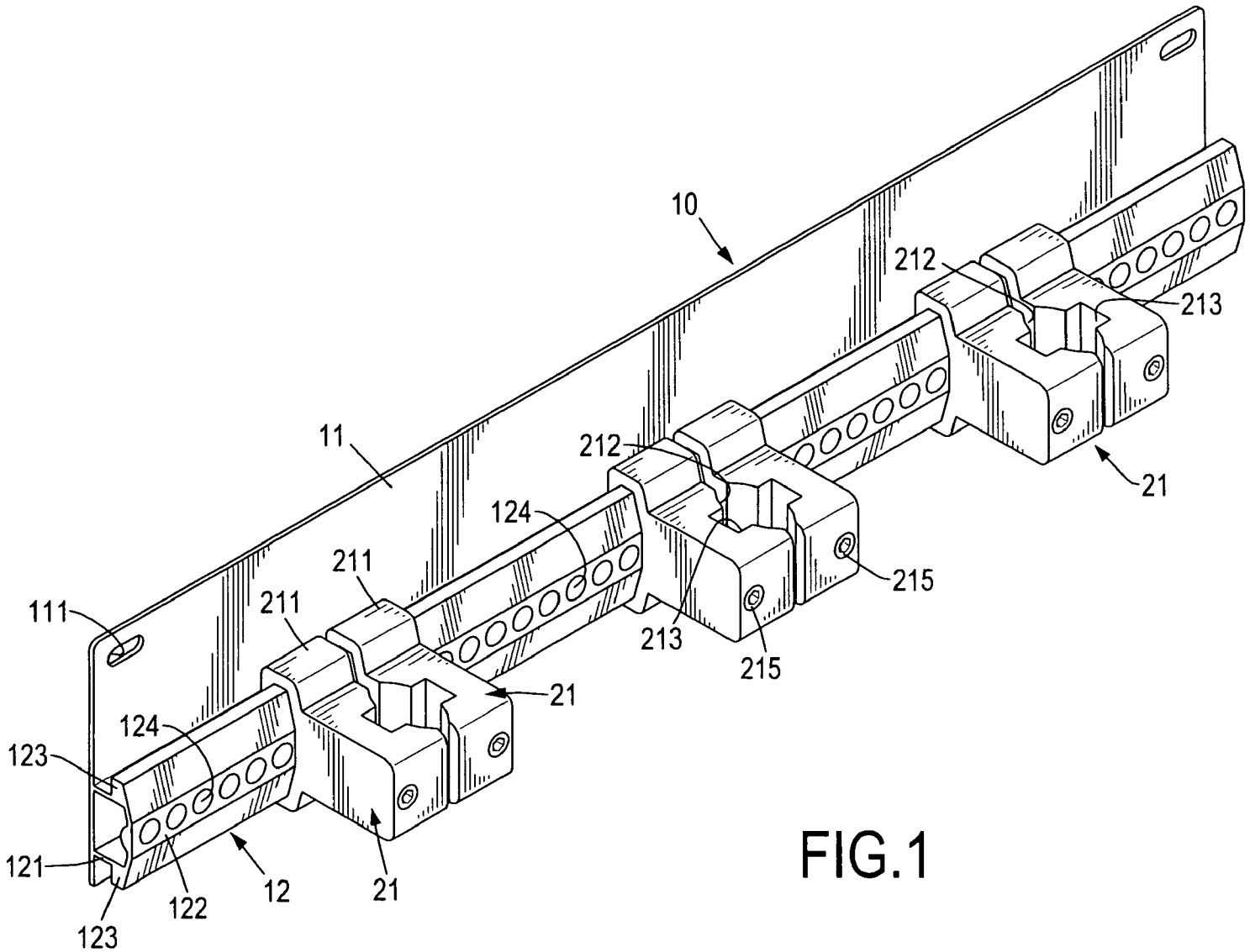
FIG. 1 is a perspective view of a tool suspension device in accordance with the present invention.
Figure 2:
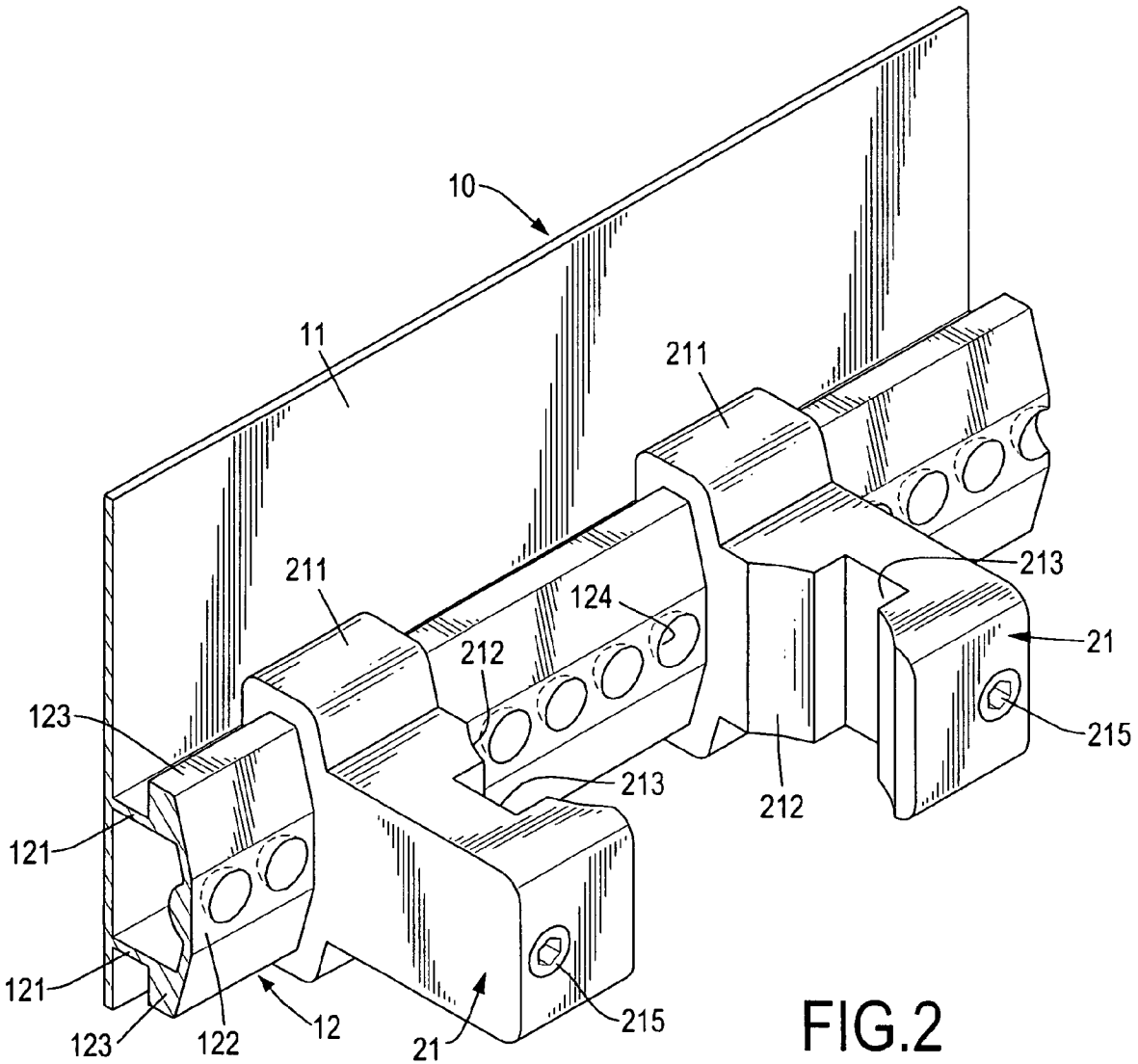
FIG. 2 is an enlarged perspective view of the tool suspension device in FIG. 1.

With reference to FIGS. 1 to 4, a tool suspension device in accordance with the present invention has a base bracket (10) and multiple clamps (21).

The base bracket (10) may be hang on a wall or other such vertical surface and has a baseboard (11) and a rail bracket (12).

The baseboard (11) has a front surface, and multiple optional hanging holes (111). The hanging holes (111) are formed through the baseboard (11).

The rail bracket (12) is formed securely on the front surface of the baseboard (11) and has a rail (122) and at least one optional spacer (121).

The rail (122) is formed on the front surface of the baseboard (11) and has a front surface, two edges, two longitudinal grooves (123) and multiple detents (124). The longitudinal grooves (123) are respectively formed in the edges of the rail (122). The detents (124) may be hemispherical and are formed in the front surface of the rail (122).

Each spacer (121) is formed between the front surface of the baseboard (11) and the rail (122) to form the longitudinal grooves (123) between the front surface of the baseboard (11) and the rail (122).

Each clamp (21) is mounted slidably on the rail (122) in pairs and has a proximal end, two hooks (211) and an arm.

The hooks (211) are formed on the proximal end of the clamp (21), corresponding to and are respectively mounted slidably in the longitudinal grooves (123) of the rail (122).

The arm of the clamp (21) is formed on and protrudes out from the hooks (211) and has a side surface, a distal end, a jaw recess (212), a mounting recess (214) and a boss.

The side surfaces of two corresponding arms (21) are mounted adjacent to each other.

The jaw recess (212) is formed in the side surface of the arm (21) and may be curved and have a middle and a rectangular recess (213). The rectangular recess (213) is formed in the middle of the jaw recess (212).

The mounting recess (214) is formed in the arm of the clamp (21) and corresponds to one of the detents (124) in the rail (122) and may be formed through the distal end of the arm and may have an inner surface and an inner thread (218). The inner thread (218) is formed on the inner surface of the mounting recess (214) near the distal end of the arm.

Figure 3:
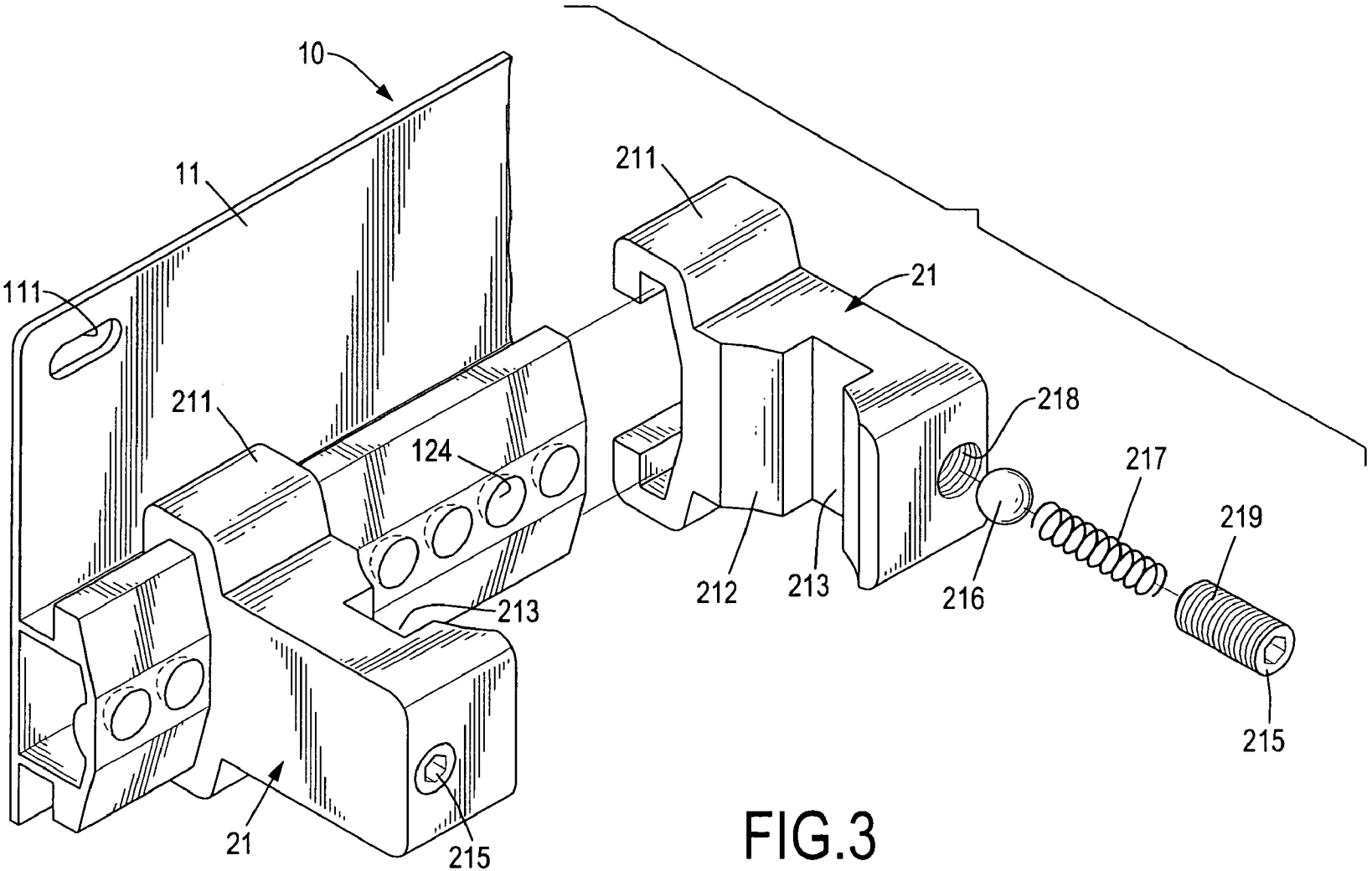
FIG. 3 is an enlarged partially exploded perspective view of the tool suspension device in FIG. 1.
Figure 4:
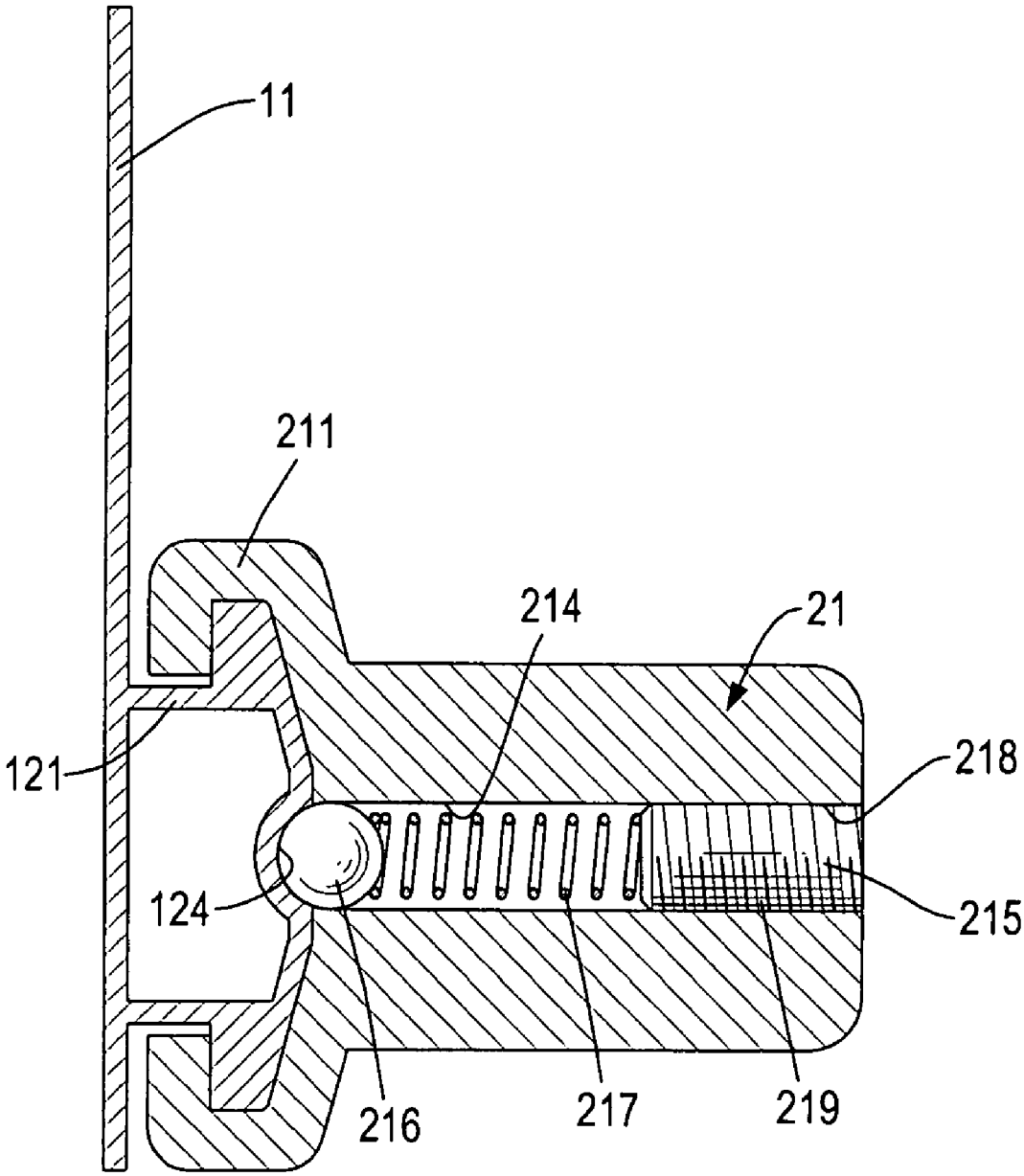
FIG. 4 is an enlarged operational side view in partial section of the tool suspension device in FIG. 1.
Figure 8:
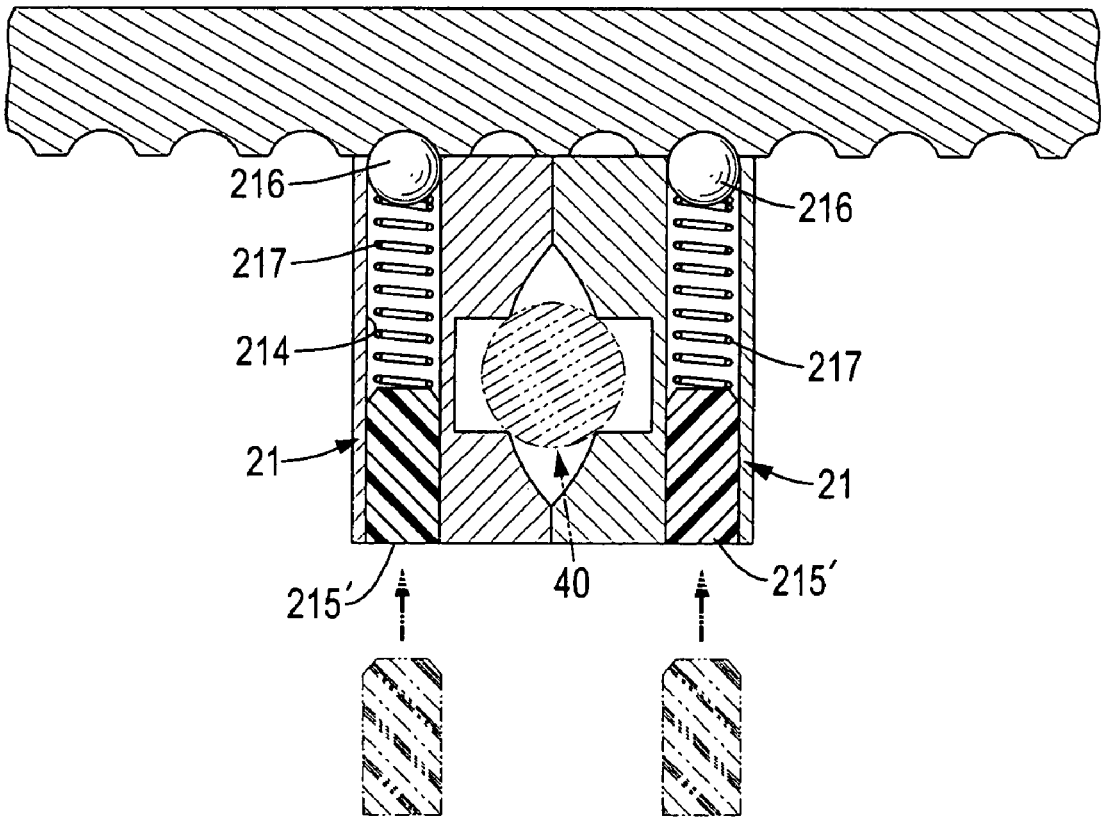
FIG. 8 is a partially exploded top view in partial section of another embodiment of a tool suspension device in accordance with the present invention to hold the socket wrench.

With further reference to FIGS. 3 and 8, the boss is mounted in the mounting recess (214) and engages the corresponding detent (124) and has an optional plug (215, 215'), a ball (216) and a spring (217). The plug (215, 215') is mounted securely in the mounting recess (214) from the distal end of the arm and may be a fastener (215) or a post (215'). The fastener (215) may have an outer thread (219). The outer thread (219) engages the inner thread (218) in the mounting recess (214). The ball (216) is mounted in the mounting recess (214). The spring (217) is mounted in the mounting recess (214) adjacent to and pressing the ball (216) into a corresponding detent (124) in the rail (122) to temporarily hold the clamp (21) securely on the rail (122).

Figure 5:
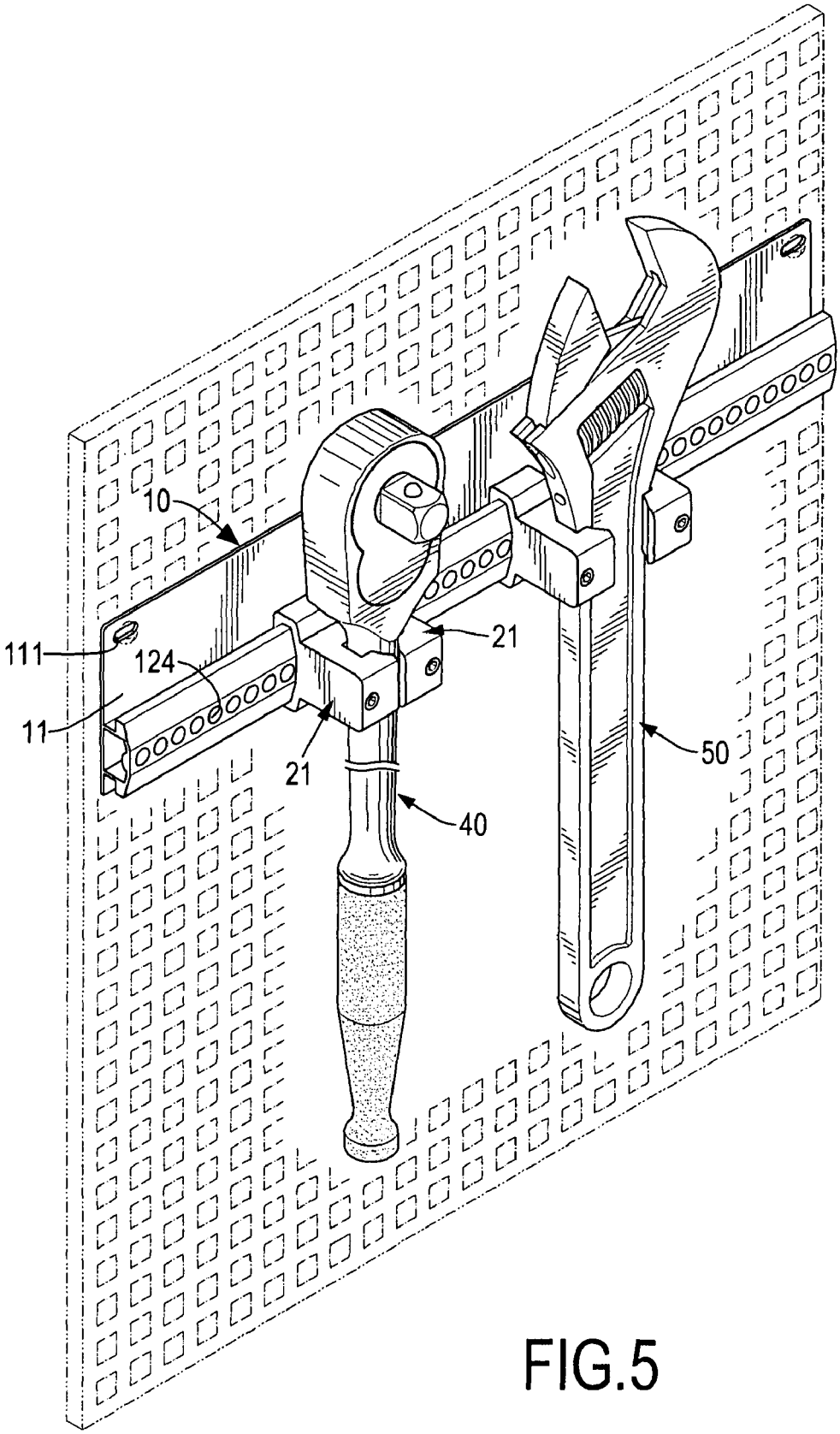
FIG. 5 is a perspective view of the tool suspension device in FIG. 2 hung on a perfboard with a socket wrench and a monkey wrench.
Figure 6A:
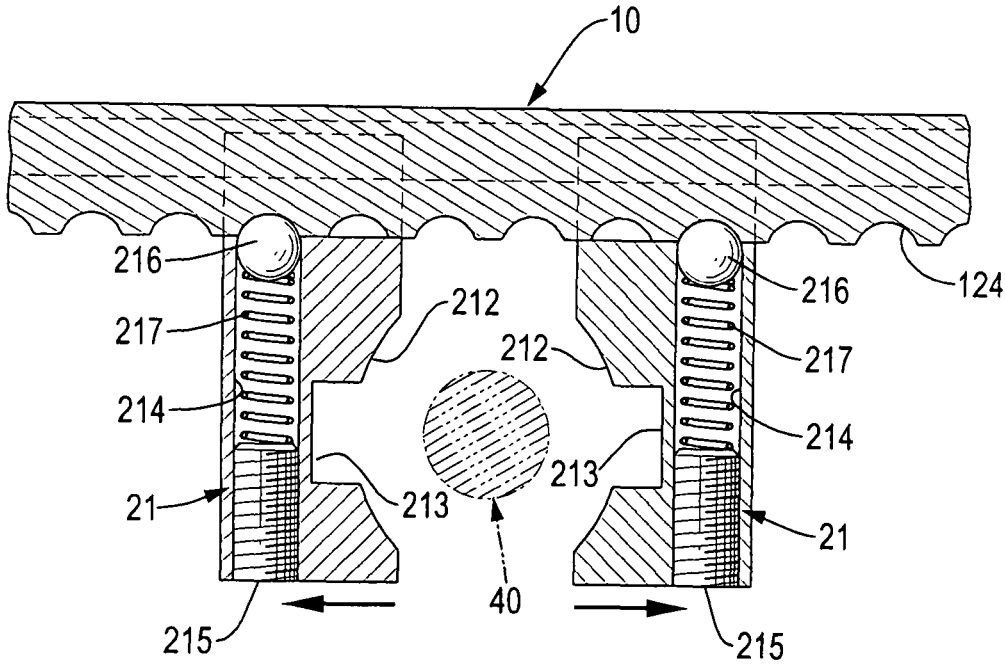
FIGS. 6A and 6B are operational top views in partial section of the tool suspension device in FIG. 1 to hold the socket wrench.
Figure 6B:
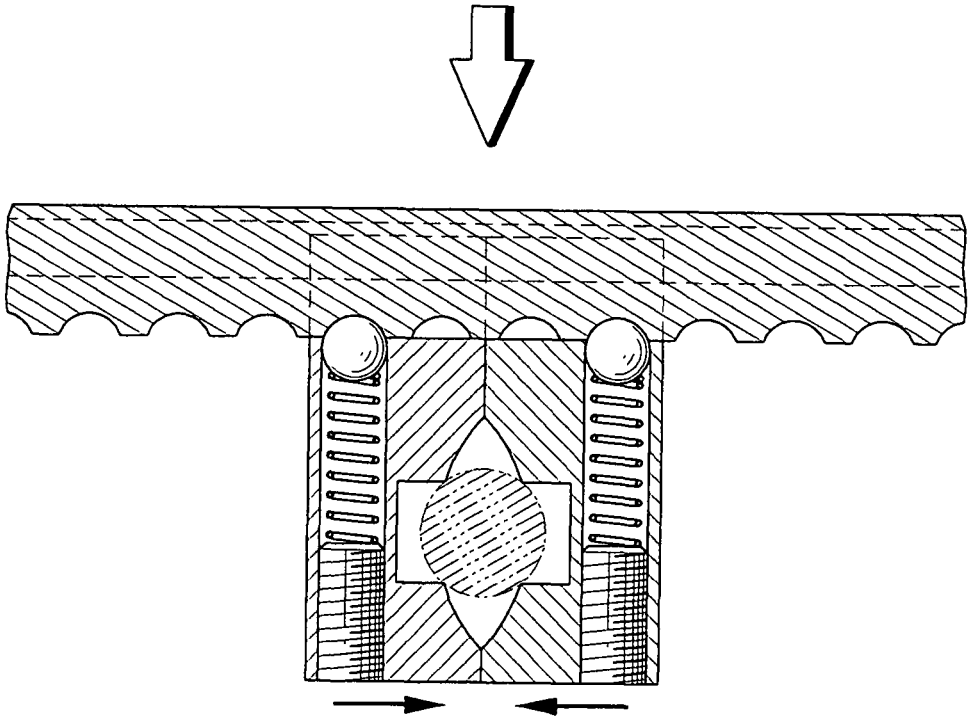
Figure 7A:
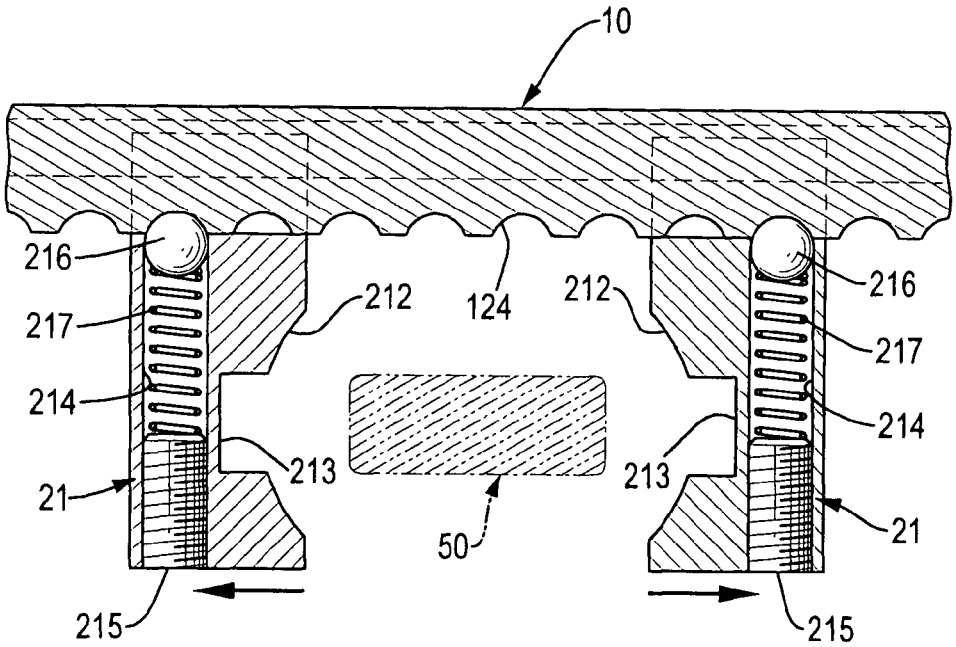
FIGS. 7A and 7B are operational top views in partial section of the tool suspension device in FIG. 1 to hold the monkey wrench.
Figure 7B:
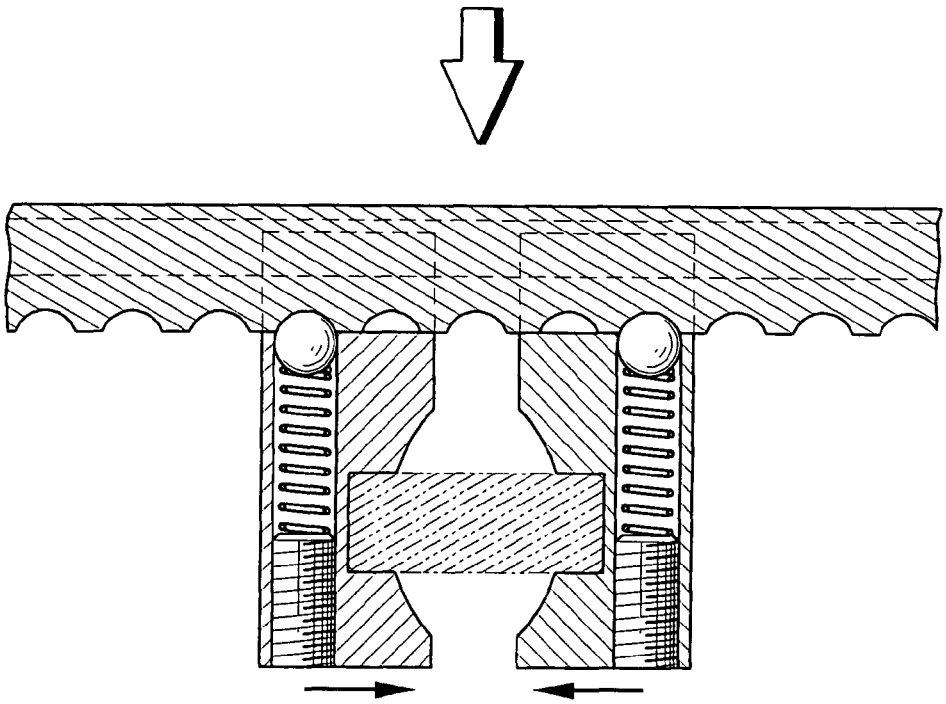

With further reference to FIG. 5, the base bracket (10) of the tool suspension device is hung on a surface such as perfboard or a wall, and a tool such as, but not limited to a socket wrench (40) or a monkey wrench (50) is clamped between the clamps (21).

With further reference to FIGS. 6A, 6B, 7A and 7B, the clamps (21) are separated to allow the wrench (40, 50) to be placed between the clamps (21). Then, the clamps (21) closed to clamp the wrench (40, 50) in the jaw recesses (212,) or in the rectangular recesses (213). Since the springs (217) push the balls (216) into the corresponding detents (124), the clamps (21) are held securely to hold the wrenches (40, 50) conveniently and easily.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tool suspension device comprising
a base bracket having
a baseboard having a front surface; and
a rail bracket being formed securely on the front surface of the baseboard and having
a rail being formed on the front surface of the baseboard and having
a front surface;
two edges; and
two longitudinal grooves being formed respectively in the edges of the rail; and
multiple detents being formed in the front surface of the rail; and
multiple clamps being mounted slidably on the rail in pairs and each clamp having
a proximal end;
two hooks being formed on the proximal end of the clamp, corresponding to and being mounted slidably in the longitudinal grooves of the rail; and
an arm being formed on and protruding out from the hooks and having
a side surface being mounted adjacently to a side surface of a corresponding arm;
a distal end;
a jaw recess being formed in the side surface of the arm;
a mounting recess being formed in the arm of the clamp and corresponding to one of the detents in the rail; and
a boss being mounted in the mounting recess and engaging a corresponding detent and having
a ball being mounted in the mounting recess; and
a spring being mounted in the mounting recess adjacent to and pressing the ball into a corresponding one of the detents in the rail to temporarily hold the clamp securely on the rail.

2. The tool suspension device as claimed in claim 1, wherein each jaw recess is curved and further has
a middle; and
a rectangular recess being formed in the middle of the jaw recess.

3. The tool suspension device as claimed in claim 2, wherein the rail bracket further has at least one spacer being formed between the front surface of the baseboard and the rail.

4. The tool suspension device as claimed in claim 3, wherein
the baseboard further has multiple hanging holes being formed through the baseboard; and
each detent is hemispherical.

5. The tool suspension device as claimed in claim 4, wherein
the mounting recess of each arm is formed through the distal end of the arm; and
the boss of each arm further has a plug being mounted securely in the mounting recess in the arm.

6. The tool suspension device as claimed in claim 4, wherein
the mounting recess of each arm is formed through the distal end of the arm and further has
an inner surface; and
an inner thread being formed on the inner surface of the mounting recess near the distal end of the arm; and
the boss of each arm further has a plug being a fastener, being mounted securely in the mounting recess in the arm and having an outer thread engaging the inner thread of the mounting recess.

7. The tool suspension device as claimed in claim 2, wherein
the mounting recess of each arm is formed through the distal end of the arm and further has
an inner surface; and
an inner thread being formed on the inner surface of the mounting recess near the distal end of the arm; and
the boss of each arm further has a plug being a fastener, being mounted securely in the mounting recess in the arm and having an outer thread engaging the inner thread in the mounting recess in the arm.

8. The tool suspension device as claimed in claim 2, wherein
the mounting recess of each arm is formed through the distal end of the arm; and
the boss of each arm further has a plug being a post, being mounted securely in the mounting recess in the arm.

9. The tool suspension device as claimed in claim 1, wherein
the rail bracket further has two spacers being formed between the front surface of the baseboard and the rail to form the longitudinal grooves.

10. The tool suspension device as claimed in claim 1, wherein
the baseboard further has multiple hanging holes being formed through the baseboard; and
each detent is hemispherical.

* * * * *